US008581799B2

(12) United States Patent
Choi et al.

(10) Patent No.: US 8,581,799 B2
(45) **Date of Patent: *Nov. 12, 2013**

(54) GROUND RADIATION ANTENNA

(75) Inventors: Hyeng-cheul Choi, Seoul (KR); Jaeseok Lee, Seoul (KR); Oul Cho, Suwon-si (KR); Xinxin Lu, Seoul (KR); Jin-hyuk Jang, Cheonan-si (KR)

(73) Assignee: Radina Co., Ltd, Seoul (KR)

( * ) Notice: Subject to any disclaimer, the term of this patent is extended or adjusted under 35 U.S.C. 154(b) by 295 days.

This patent is subject to a terminal disclaimer.

(21) Appl. No.: 13/081,063

(22) Filed: Apr. 6, 2011

(65) Prior Publication Data

US 2011/0210898 A1 Sep. 1, 2011

Related U.S. Application Data

(63) Continuation of application No. PCT/KR2010/009339, filed on Dec. 24, 2010.

(30) Foreign Application Priority Data

| | | |
|---|---|---|
| Feb. 11, 2010 | (KR) | 10-2010-0012775 |
| Apr. 9, 2010 | (KR) | 10-2010-0032922 |
| May 7, 2010 | (KR) | 10-2010-0043186 |
| May 7, 2010 | (KR) | 10-2010-0043189 |
| May 7, 2010 | (KR) | 10-2010-0043190 |
| Jun. 14, 2010 | (KR) | 10-2010-0056207 |
| Dec. 23, 2010 | (KR) | 10-2010-0133920 |

(51) Int. Cl.
*H01Q 1/48* (2006.01)

(52) U.S. Cl.
USPC ..... 343/845; 343/846; 343/847

(58) Field of Classification Search
USPC ..... 343/845–847
See application file for complete search history.

(56) References Cited

U.S. PATENT DOCUMENTS

2004/0095280 A1 * 5/2004 Poilasne et al. ..... 343/702

FOREIGN PATENT DOCUMENTS

| | | | |
|---|---|---|---|
| EP | 1962372 | A1 | 8/2008 |
| KR | 10-2006-0017281 | A | 2/2006 |
| KR | 10-2007-0112169 | A | 11/2007 |
| KR | 10-2009-0017964 | A | 2/2009 |
| KR | 10-2009-0030116 | A | 3/2009 |
| KR | 10-1003014 | B1 | 12/2010 |

OTHER PUBLICATIONS

U.S. Office Action in U.S. Appl. No. 13/081,014 dated Mar. 29, 2013.
U.S. Office Action in U.S. Appl. No. 13/081,104 dated Mar. 29, 2013.
International Search Report in International Application No. PCT/KR2010/009338, dated Aug. 16, 2011.
International Search Report in International Application No. PCT/KR2010/009339, dated Aug. 16, 2011.
International Search Report in International Application No. PCT/KR2010/009340, dated Aug. 16, 2011.

* cited by examiner

*Primary Examiner* — Kristy A Haupt
(74) *Attorney, Agent, or Firm* — Park, Kim & Suh, LLC

(57) ABSTRACT

A ground radiation antenna is disclosed. Herein, the ground radiation antenna provides a radiator-forming circuit, which is formed to have a simple structure using a capacitive element, as well as a feeding circuit suitable for the provided radiator-forming circuit. Thus, the structure of the antenna becomes simpler and the size of the antenna becomes smaller. Accordingly, the fabrication process of the antenna is simplified, thereby largely reducing the fabrication cost.

16 Claims, 9 Drawing Sheets

GROUND RADIATION ANTENNA

CROSS REFERENCE TO PRIOR APPLICATIONS

This application claims the benefit under 35 U.S.C. §120 and §365(c) to a prior PCT International Patent Application No. PCT/KR2010/009339 (filed on Dec. 24, 2010 and designating the U.S.), which claims priority to Korean Patent Application Nos. 10-2010-0012775 (filed on Feb. 11, 2010), 10-2010-0032922 (filed on Apr. 9, 2010), 10-2010-0043186 (filed on May 7, 2010), 10-2010-0043189 (filed on May 7, 2010), 10-2010-0043190 (filed on May 7, 2010), 10-2010-0056207 (filed on Jun. 14, 2010) and 10-2010-0133920 (filed on Dec. 23, 2010), which are all hereby incorporated by reference in their entirety.

BACKGROUND OF THE INVENTION

1. Field of the Invention

The present invention relates to an antenna and, more particularly, to a ground radiation antenna using ground radiation of a wireless communication terminal.

2. Related Art Technology

An antenna is a device that receives RF signals from air into a wireless communication terminal or transmits RF signals from the wireless communication terminal to air. In other words, the antenna is an essential element used in wireless communication. Recently, the mobile telecommunication terminals are required to be compact in size, lightweight, and equipped with a slimmer antenna structure. Also, as the data size being transmitted and received through wireless communication has become larger, mobile telecommunication terminals need antennaes providing greater performance.

Accordingly, the ground radiation antenna has been proposed to meet such demands. Herein, the ground radiation antenna uses the ground to radiate RF signals. More specifically, a radiator of a related art antenna is provided with a separate radiator occupying a large volume inside or outside of the mobile telecommunication terminal. However, by using the ground as the radiator, the ground being essentially provided in a wireless communication terminal, the size of the antenna may be largely reduced in the ground radiation antenna.

However, even in the ground radiation antenna, the radiator cannot be fully functional by using only the ground. Therefore, the ground radiation antenna is additionally provided with a separate radiating element, which performs the role of the radiator along with the ground.

Accordingly, the related art ground radiation antenna is disadvantageous in that, due to the radiating element having a large volume and a complex structure, the size of the ground radiation antenna became larger, and the fabrication process of the antenna became very complex.

SUMMARY OF THE INVENTION

Object of the Invention

An object of the present invention is to provide a ground radiation antenna having a remarkably simple structure and also showing an excellent radiating performance.

Technical Solutions of the Invention

Based upon the characteristics of the ground antenna itself, the present invention provides a radiator-forming circuit using a capacitive element that can replace the radiating element having a complex structure.

Additionally, the present invention also provides a feeding scheme (or feeding circuit) that can maximize the radiating performance, while having a simple structure.

As described above, by fabricating an antenna using a radiator-forming circuit and a feeding circuit each having a noticeably simplified structure, the present invention provides an antenna that is smaller in size and that shows an excellent radiating performance.

Effect of the Invention

The ground radiation antenna according to the present invention is advantageous in that the antenna is configured of an extremely simple structure, thereby being capable of reducing the size of the antenna.

Also, due to its simple structure, the ground radiation antenna according to the present invention may simplify the fabrication process, thereby being capable of reducing the fabrication cost to a remarkable level.

Furthermore, the ground radiation antenna according to the present invention may have the characteristics of a broadband and a multi-band and may provide users with an excellent radiation performance.

DETAILED DESCRIPTION OF THE INVENTION

In the related art antenna, efforts were made to enhance the radiation performance by separately equipping the antenna with a radiating element for ground radiation, and by varying the formation or structure of the radiating element. More specifically, efforts were made for realizing a radiator by combining an element having both inductance and capacitance with a capacitor and an inductor.

However, the applicant was able to discover that an excellent ground radiating element could be fabricated when using the inductance of the ground, by simply connecting the capacitor to the ground, without having to use a separate element configured of a complex structure.

In order to function as the radiating element of the antenna, the capacitor having the capacitance and the inductor having the inductance should both exist so as to create a resonance. The application also discovered that, since the ground provides the inductance required to generate the resonance, only the capacitor and the ground were required to perform the function of the radiating element without having to be equipped with a separate element for providing the inductance.

However, the related art ground radiators were incapable of efficiently using the inductance provided from the ground. And, accordingly, efforts were made in the related art in trying to generate resonance by configuring elements having a complex structure and being provided with both capacitance and inductance.

Conversely, according to the present invention, by being capable of efficiently using the inductance provided from the ground itself, a radiator having a simple structure may be configured to connect the capacitor to the ground, and an antenna using the above-described radiator may be provided.

Figure 1:
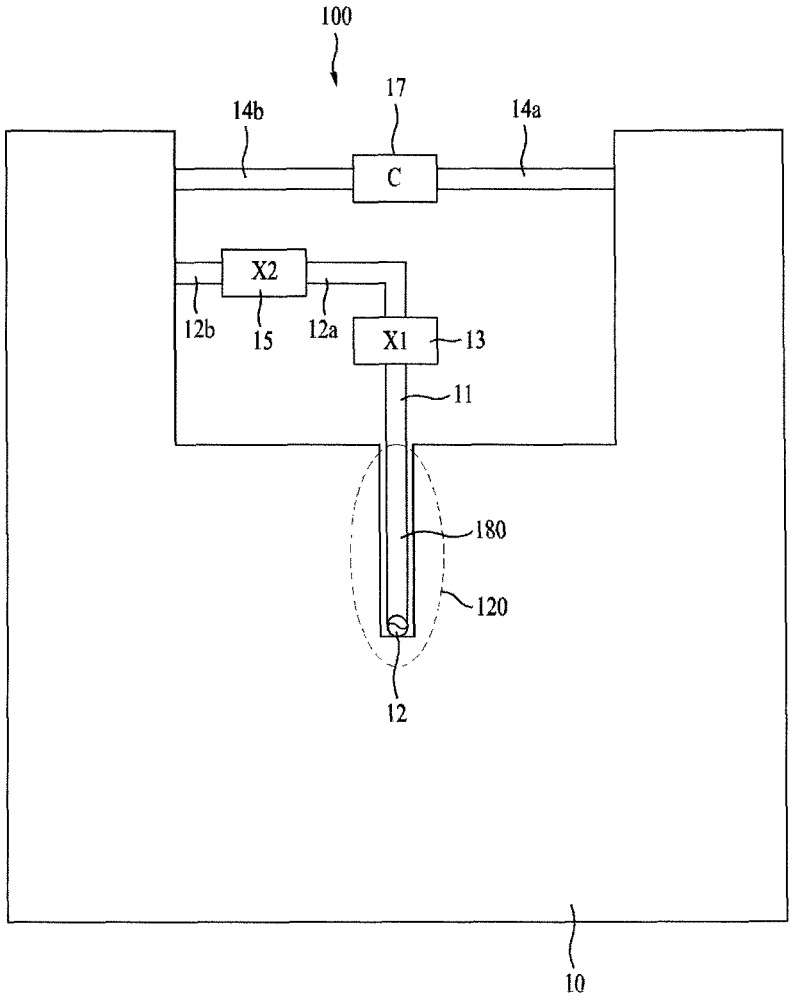
FIG. 1 illustrates an antenna using ground radiation according to a first embodiment of the present invention.

FIG. 1 illustrates an antenna using ground radiation according to a first embodiment of the present invention.

Referring to FIG. 1, the antenna using ground radiation according to the first embodiment of the present invention includes a feeding part 120 configured of a feeding source 12 and a feeding transmission line 180, a feeding source 12, a ground 10, a first conductor line 11, a first element 13, a second conductor line 12*a*, a second element 15, a third conductor line 12*b*, a capacitive element 17, a fourth conductor line 14*a*, and a fifth conductor line 14*b*.

The ground 10 provides a reference voltage inside a telecommunication device, such as a mobile communication user terminal (or user equipment). Generally, it is preferable that a user terminal ground is formed in a printed circuit board (PCB), wherein circuit devices required for the operation of the user equipment (or terminal) are combined with one another. According to the present invention, in addition to providing the reference voltage, the ground 10 also performs the function of a ground radiator of the antenna. This characteristic is equally applied to the other embodiments of the present invention, which will be described in detail later on.

According to the first embodiment of the present invention, the feeding part 120, the first conductor line 11, the first element 13, the second conductor line 12*a*, the second element 15, and the third conductor line 12*b* collectively operate as a feeding circuit for exciting the antenna, so that radiation of an RF signal can occur through the antenna radiator. Additionally, the fourth conductor line 14*a*, the capacitive element 17, and the fifth conductor line 14*b* operate in collaboration (or collectively) as an antenna radiator-forming circuit, which enables the RF signal to be actually radiated.

More specifically, according to the first embodiment of the present invention, the feeding part 120, the first conductor line 11, the first element 13, the second conductor line 12*a*, the second element 15, and the third conductor line 12*b* collectively operate as the feeding circuit, and, depending upon the feeding of the feeding circuit (or feeding scheme), the fourth conductor line 14*a*, the capacitive element 17, and the fifth conductor line 14*b* collectively operate as the antenna radiator-forming circuit, which enables the RF signal to be radiated.

According to the first embodiment of the present invention, the first element 13 may correspond to an inductive element, a capacitive element, or a simple conductive line. Moreover, the second element 15 may also correspond to an inductive element, a capacitive element, or a simple conductive line.

At this point, in case the first element 13 is a capacitive element, the first conductor line 11, the first element 13, the second conductor line 12*a*, the second element 15, and the third conductor line 12*b* may collectively operate as the feeding circuit and may also collectively operate as the radiator-forming circuit. And, the antenna according to the first embodiment of the present invention may have the multi-band characteristic.

According to the first embodiment of the present invention, the feeding part 120 is configured of a coplanar waveguide (CPW). However, in addition to the CPW, a variety of other types of feeding part may be configured in the present invention. Such characteristic is equally applied to the other embodiments of the present invention.

According to the first embodiment of the present invention, the feeding circuit is configured inside of a clearance area 100. The clearance area 100 corresponds to an area within the user terminal ground 10 having a portion of the ground removed therefrom.

According to the first embodiment of the present invention, it is preferable that the capacitive element corresponds to a lumped circuit element, such as a chip capacitor. However, in addition to the chip capacitor, a capacitive element having a general capacitive structure may also be used in the first embodiment of the present invention. Furthermore, the capacitive element may either be configured of a single capacitor, or may be configured by connecting two or more capacitors to one another.

Meanwhile, according to the first embodiment of the present invention, in order to obtain a specific capacitance, the capacitive element 13 may be replaced with a combination of multiple elements. For example, the capacitive element 13 may be replaced with a combined structure of a capacitive element and an inductive element.

Furthermore, in the other embodiments of the present invention that will be described hereinafter, in order to obtain a specific capacitance, the capacitive element may be replaced with a combination of multiple elements. For example, the capacitive element may be replaced with a combined structure of a capacitive element and an inductive element.

Figure 2:
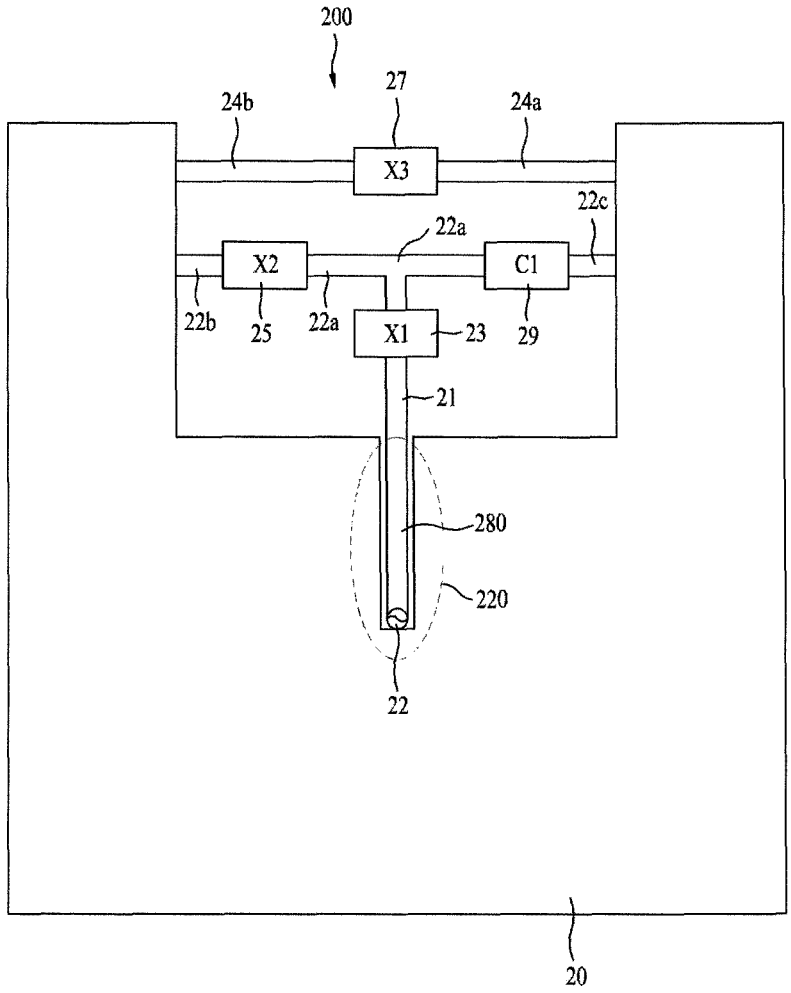
FIG. 2 illustrates an antenna using ground radiation according to a second embodiment of the present invention.

FIG. 2 illustrates an antenna using ground radiation according to a second embodiment of the present invention.

Referring to FIG. 2, the antenna using ground radiation according to the second embodiment of the present invention includes a feeding part 220 configured of a feeding source 22 and a feeding transmission line 280, a ground 20, a first conductor line 21, a first element 23, a second conductor line 22*a*, a second element 25, a third conductor line 22*b*, a third element 27, a fourth conductor line 24*a*, a fifth conductor line 24*b*, a capacitive element 29, and a sixth conductor line 22*c*.

According to the second embodiment of the present invention, the feeding part 220, the first conductor line 21, the first element 23, the second conductor line 22*a*, the second element 25, and the third conductor line 22*b* collectively operate as a feeding circuit for exciting the antenna, so that radiation of an RF signal can occur through 24*a*, the third element 27, and the fifth conductor line 24*b* operate in collaboration (or collectively) as a first antenna radiator-forming circuit, which enables the RF signal to be actually radiated. Furthermore, the first conductor line 21, the first element 23, the second conductor line 22*a*, the capacitive element 29, and the sixth conductor line 22*c* collectively operate as a second antenna radiator-forming circuit. By being provided with a plurality of radiator-forming circuits, the antenna according to the second embodiment of the present invention may have the multi-band characteristic.

The third conductor line 22*b* and the second element 25 are added so as to facilitate impedance matching.

According to the second embodiment of the present invention, the first element 23 may correspond to an inductive element, a capacitive element, or a simple conductive line.

The second element 25 may correspond to an inductive element or a simple conductive line. Meanwhile, the third element 27 may correspond to an inductive element, a capacitive element, or a simple conductive line.

According to the second embodiment of the present invention, the feeding circuit is configured inside of a clearance area 200. The clearance area 200 corresponds to an area within the user terminal ground 20 having a portion of the ground removed therefrom.

According to the second embodiment of the present invention, it is preferable that the capacitive element corresponds to a lumped circuit element, such as a chip capacitor. However, in addition to the chip capacitor, a capacitive element having a general capacitive structure may also be used in the second embodiment of the present invention. Furthermore, the capacitive element may either be configured of a single capacitor, or may be configured by connecting two or more capacitors to one another.

Figure 3:
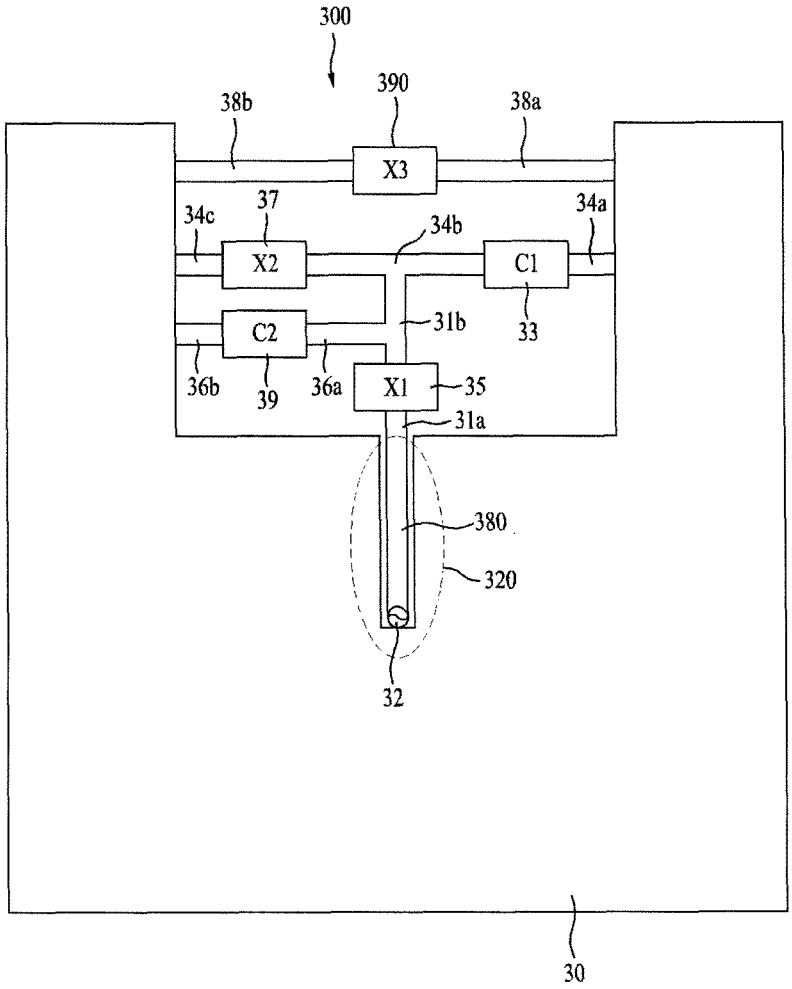
FIG. 3 illustrates an antenna using ground radiation according to a third embodiment of the present invention.

FIG. 3 illustrates an antenna using ground radiation according to a third embodiment of the present invention.

Referring to FIG. 3, the antenna using ground radiation according to the third embodiment of the present invention includes a feeding part 320 configured of a feeding source 32 and a feeding transmission line 380, a ground 30, a first conductor line 31*a*, a first element 35, a second conductor line 31*b*, a first capacitive element 33, a third conductor line 34*a*, a fourth conductor line 34*b*, a second element 37, a fifth conductor line 34*c*, a sixth conductor line 36*a*, a second capacitive element 39, a seventh conductor line 36*b*, an eighth conductor line 38*a*, a third element 390, and a ninth conductor line 38*b*.

According to the third embodiment of the present invention, the feeding part 320, the first conductor line 31*a*, the first element 35, the second conductor line 31*b*, the fourth conductor line 34*b*, the first capacitive element 33, and the third conductor line 34*a* collectively operate as a first feeding circuit for exciting the antenna, so that radiation of an RF signal can occur through the antenna radiator.

Also, the first conductor line 31*a*, the first element 35, the second conductor line 31*b*, the fourth conductor line 34*b*, the first capacitive element 33, and the third conductor line 34*a* actually operate in collaboration (or collectively) as a first antenna radiator-forming circuit, which enables the RF signal to be radiated.

More specifically, according to the third embodiment of the present invention, the first conductor line 31*a*, the first element 35, the second conductor line 31*b*, the fourth conductor line 34*b*, the first capacitive element 33, and the third conductor line 34*a* not only correspond to portions of the feeding circuit of the antenna but also correspond to portions of a radiator-forming circuit.

Additionally, the feeding part 320, the first conductor line 31*a*, the first element 35, the sixth conductor line 36*a*, the second capacitive element 39, and the seventh conductor line 36*b* collectively operate as a second feeding circuit for exciting the antenna, so that radiation of an RF signal can occur through the antenna radiator.

Also, the first conductor line 31*a*, the first element 35, the sixth conductor line 36*a*, the second capacitive element 39, and the seventh conductor line 36*b* operate in collaboration (or collectively) as a second antenna radiator-forming circuit, which enables the RF signal to be actually radiated.

More specifically, according to the third embodiment of the present invention, the first conductor line 31*a*, the first element 35, the sixth conductor line 36*a*, the second capacitive element 39, and the seventh conductor line 36*b* not only correspond to portions of the feeding circuit of the antenna but also correspond to portions of a radiator-forming circuit.

Meanwhile, the eighth conductor line 38*a*, the third element 390, and the ninth conductor line 38*b* collectively operate as a third antenna radiator-forming circuit.

The antenna according to the third embodiment of the present invention may realize a multi-band characteristic due to a triple antenna radiator-forming circuit.

Meanwhile, the fifth conductor line 34*c* and the second element 37 correspond to elements that are added in order to facilitate impedance matching.

According to the third embodiment of the present invention, the first element 35 may correspond to an inductive element, a capacitive element, or a simple conductive line. And, the second element 37 may correspond to an inductive element or a simple conductive line.

According to the third embodiment of the present invention, the feeding circuit is configured inside of a clearance area 300. The clearance area 300 corresponds to an area within the user terminal ground 30 having a portion of the ground removed therefrom.

According to the third embodiment of the present invention, it is preferable that the capacitive element corresponds to a lumped circuit element, such as a chip capacitor. However, in addition to the chip capacitor, a capacitive element having a general capacitive structure may also be used in the third embodiment of the present invention. Furthermore, the capacitive element may either be configured of a single capacitor, or may be configured by connecting two or more capacitors to one another.

Figure 4:
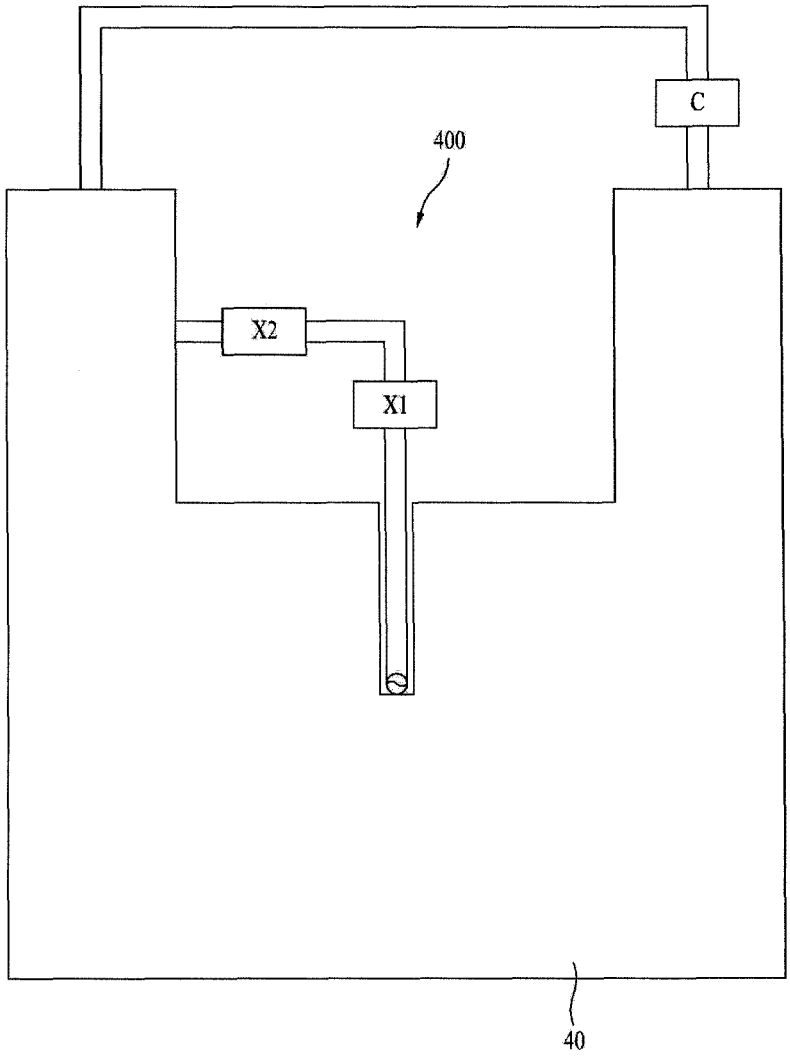
FIG. 4 illustrates an antenna using ground radiation according to a fourth embodiment of the present invention.

FIG. 4 illustrates an antenna using ground radiation according to a fourth embodiment of the present invention.

Although the antenna according to the fourth embodiment of the present invention has the same structure as the antenna according to the first embodiment of the present invention, a portion of the antenna is formed in the clearance area 400, and another portion of the antenna is formed outside of the clearance area 400.

Figure 5:
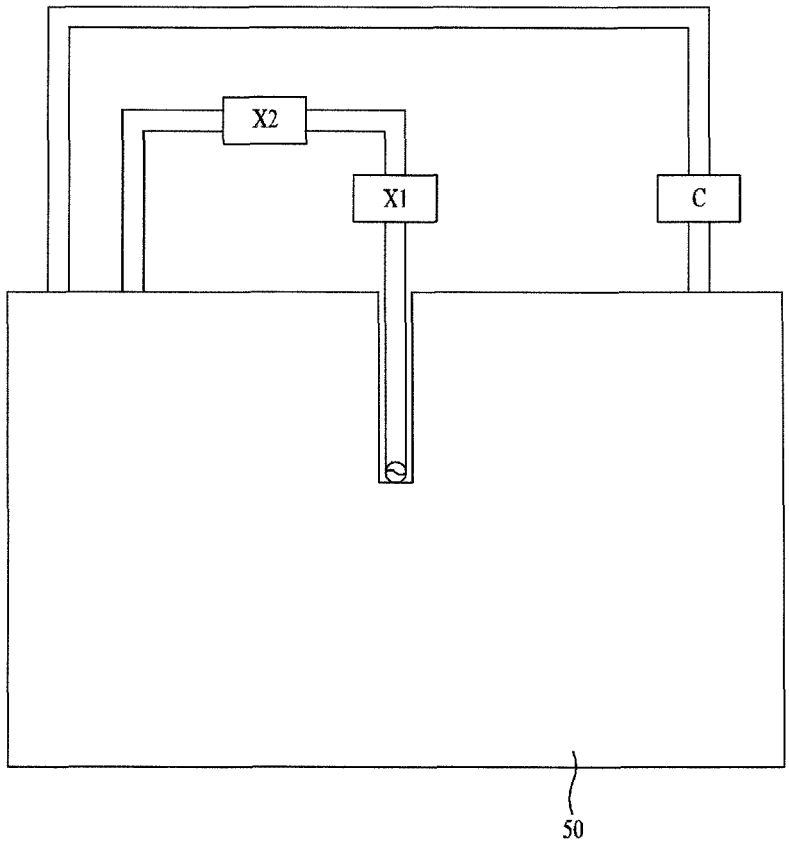
FIG. 5 illustrates an antenna using ground radiation according to a fifth embodiment of the present invention.

FIG. 5 illustrates an antenna using ground radiation according to a fifth embodiment of the present invention.

Although the antenna according to the fifth embodiment of the present invention has the same structure as the antenna according to the first embodiment of the present invention, a separate clearance is not formed in the antenna according to the fifth embodiment of the present invention. Furthermore, the antenna according to the fifth embodiment of the present invention is configured in an area that is not surrounded by the ground.

Figure 6:
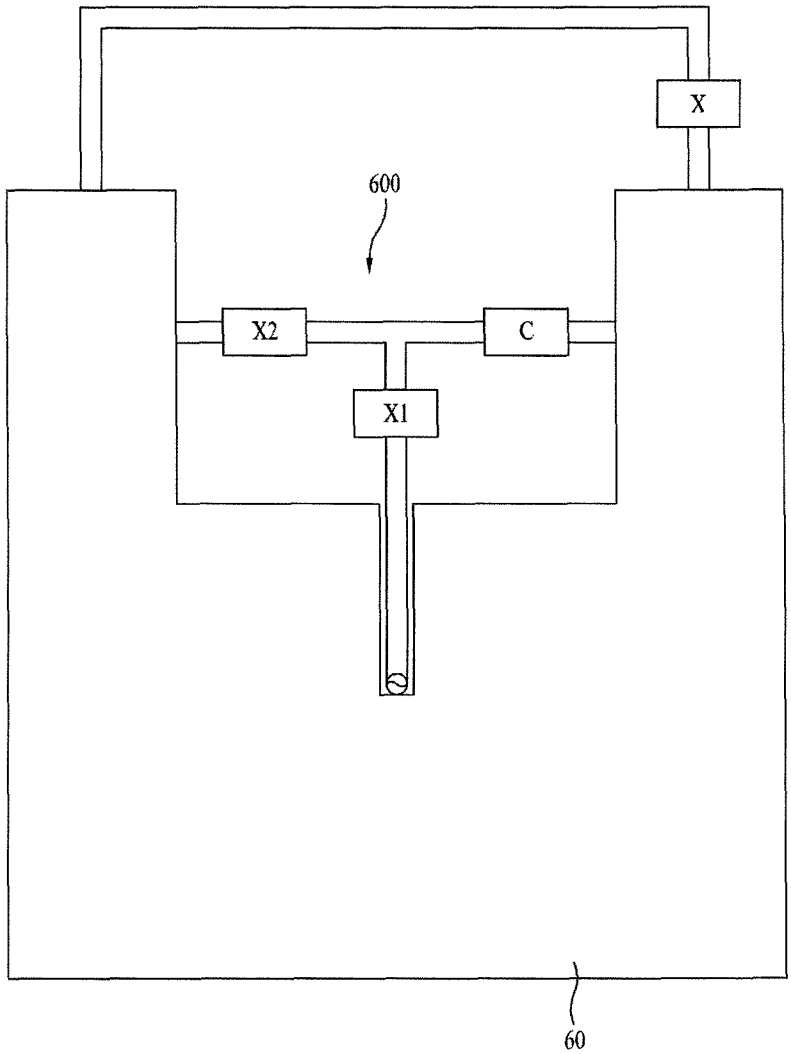
FIG. 6 illustrates an antenna using ground radiation according to a sixth embodiment of the present invention.

FIG. 6 illustrates an antenna using ground radiation according to a sixth embodiment of the present invention. Although the antenna according to the sixth embodiment of the present invention has the same structure as the antenna according to the second embodiment of the present invention, a portion of the antenna is formed in the clearance area 600, and another portion of the antenna is formed outside of the clearance area 600.

Figure 7:
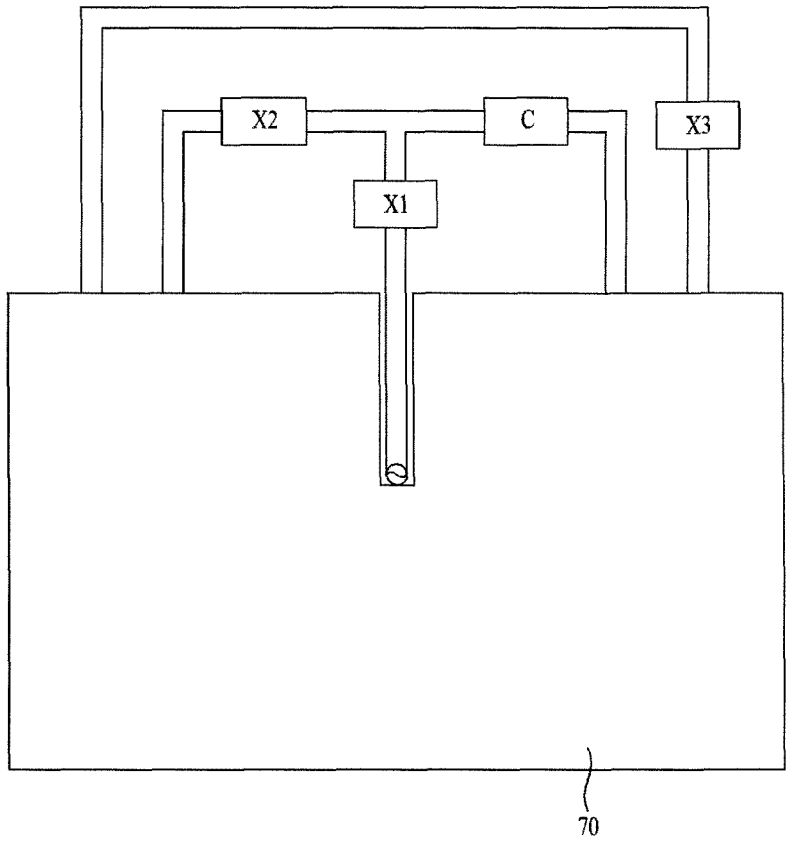
FIG. 7 illustrates an antenna using ground radiation according to a seventh embodiment of the present invention.

FIG. 7 illustrates an antenna using ground radiation according to a seventh embodiment of the present invention.

Although the antenna according to the seventh embodiment of the present invention has the same structure as the antenna according to the second embodiment of the present invention, a separate clearance is not formed in the antenna according to the seventh embodiment of the present invention. Furthermore, the antenna according to the seventh embodiment of the present invention is configured in an area that is not surrounded by the ground.

Figure 8:
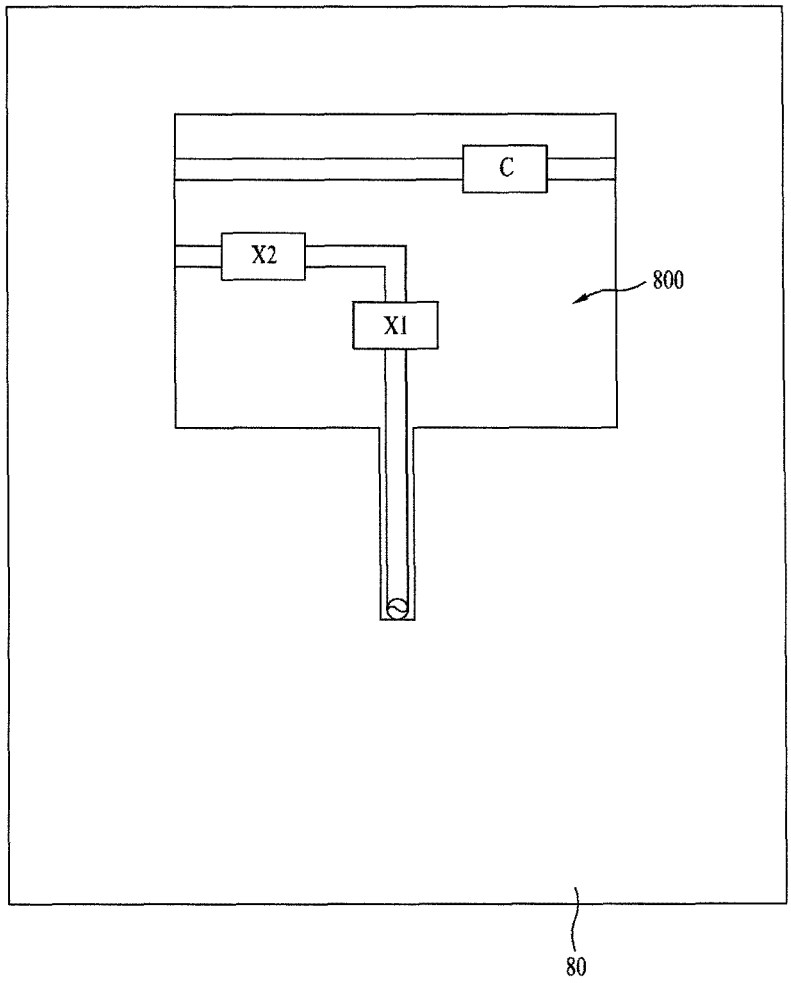
FIG. 8 illustrates an antenna using ground radiation according to an eighth embodiment of the present invention.

FIG. 8 illustrates an antenna using ground radiation according to an eighth embodiment of the present invention.

Although the antenna according to the eighth embodiment of the present invention has the same basic structure as the antenna according to the first embodiment of the present invention, the shape of the clearance is different from the antenna according to the first embodiment of the present invention.

More specifically, the clearance of the antenna according to the first embodiment of the present invention has three sides surrounded by the ground, and only one side of the clearance is open. However, the clearance 800 of the antenna according to the eighth embodiment of the present invention is formed to have all four sides surrounded by the ground 80.

Figure 9:
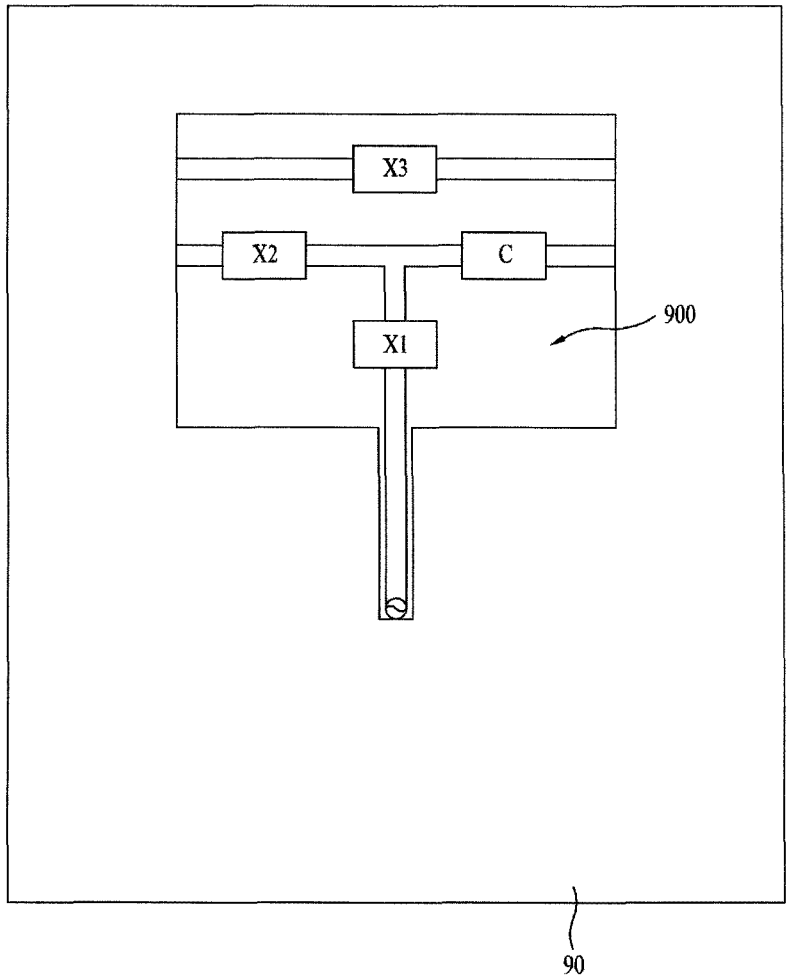
FIG. 9 illustrates an antenna using ground radiation according to a ninth embodiment of the present invention.

FIG. 9 illustrates an antenna using ground radiation according to a ninth embodiment of the present invention.

Although the antenna according to the ninth embodiment of the present invention has the same basic structure as the antenna according to the second embodiment of the present invention, the shape of the clearance is different from the antenna according to the second embodiment of the present invention.

More specifically, the clearance of the antenna according to the second embodiment of the present invention has three sides surrounded by the ground, and only one side of the clearance is open. However, the clearance 900 of the antenna according to the ninth embodiment of the present invention is formed to have all four sides surrounded by the ground 90.

As described above, each of the first, fourth, fifth, and eighth embodiments of the present invention belongs to an antenna group having the same basic connection.

However, depending upon the shape of the clearance, depending upon whether or not a portion of the antenna or the entire antenna is formed in the clearance, and depending upon whether or not the antenna is formed outside of the clearance, each of the first, fourth, fifth, and eighth embodiments may be formed to have a different shape. Therefore, by creating a clearance having two sides surrounded by the ground and two sides open to the outside, and by applying this structure to each embodiment of the present invention, the antenna may be formed to have a wide range of shapes other than the shapes shown in the drawings.

Therefore, the clearance having two sides open to the outside may also be applied to the second, sixth, and seventh embodiments of the present invention, each belonging to the same antenna group.

The invention claimed is:

1. An antenna comprising:

a clearance area formed on a circuit board, wherein one part of the clearance area is open and the other part of the clearance area borders a ground area formed on the circuit board, wherein the clearance area and the ground area are formed on a same plane;

a first conductor line formed in the clearance area, both ends of the first conductor line being connected to the ground area, wherein the first conductor line comprises at least one capacitor, the capacitor being a lumped element with a constant value;

a feeding part, provided at the circuit board, comprising a feeding transmission line and a feeding source; and a second conductor line formed in an area within the clearance area which is surrounded by the first conductor line and the ground area, wherein one end of the second conductor line is connected to the ground area and the other end of the second conductor line is connected to the feeding part.

2. The antenna of claim 1, wherein the capacitor is a chip-capacitor.

3. The antenna of claim 1, wherein the clearance area has a rectangular shape.

4. The antenna of claim 3, wherein at least one side of the rectangular clearance area is open.

5. The antenna of claim 1, wherein the second conductor line is a straight line.

6. The antenna of claim 1, wherein the second conductor line directly connects the first conductor line and the feeding part without any lumped element.

7. The antenna of claim 1, wherein the second conductor line includes at least one inductive element.

8. A method of manufacturing an antenna, the method comprising:

forming a ground area on a circuit board;

forming a clearance area on the circuit board, wherein one part of the clearance area is open and the other part of the clearance area borders the ground area, wherein the ground area and the clearance area are formed on a same plane;

forming a first conductor line in the clearance area, both ends of the first conductor line being connected to the ground area, wherein the first conductor line comprises at least one capacitor, the capacitor being a lumped element with a constant value;

forming a second conductor line in an area within the clearance area which is surrounded by the first conductor line and the ground area; and providing a feeding part on the circuit board, the feeding part comprising a feeding transmission line and a feeding source, wherein one end of the second conductor line is connected to the ground area and the other end of the second conductor line is connected to the feeding part.

9. The method of claim 8, wherein the capacitor is a chip-capacitor.

10. The method of claim 8, wherein the clearance area has a rectangular shape.

11. The method of claim 10, wherein at least one side of the rectangular clearance area is open.

12. The method of claim 8, wherein the second conductor line is a straight line.

13. The method of claim 8, wherein the second conductor line directly connects the first connector line and the feeding part without any lumped element.

14. The method of claim 8, wherein the second conductor line includes at least one inductive element.

15. An antenna comprising:

a ground area formed on a circuit board;

a clearance area formed within the ground area, wherein the ground area and the clearance area are formed on a same plane and at least one side of the clearance area does not border with the ground area;

a first conductor line formed in the clearance area, both ends of the first conductor line being connected to the ground area, the first conductor line comprising at least one capacitor such that a combination of the first conductor line and the capacitor function as a radiator-forming circuit;

a feeding part, provided on the circuit board, comprising a feeding transmission line and a feeding source; and a second conductor line formed in an area within the clearance area which is surrounded by the first conductor line and the ground area, wherein a first end of the second conductor line is connected to the ground area and a second end of the second conductor line is connected to an end of the transmission line such that a combination of the second conductor line and the feeding part function as a feeding circuit for exciting the antenna.

16. A method of manufacturing an antenna, the method comprising:

forming a ground area on a circuit board;

forming a clearance area within the ground area, wherein the ground area and the clearance area are formed on a same plane and at least one side of the clearance does not border with the ground area;

forming a first conductor line in the clearance area, both ends of the first conductor line being connected to the ground area, the first conductor line comprising at least one capacitor such that a combination of the first conductor line and the capacitor function as a radiator-forming circuit;

forming a second conductor line in an area within the clearance area which is surrounded by the first conductor line and the ground area; and providing a feeding part on the circuit board, the feeding part comprising a feeding transmission line and a feeding source, wherein a first end of the second conductor line is connected to the ground area and a second end of the second conductor line is connected to an end of the transmission line such that a combination of the second conductor line and the feeding part function as a feeding circuit for exciting the antenna.

* * * * *